US007695124B2

(12) United States Patent
Van Roy

(10) Patent No.: US 7,695,124 B2
(45) Date of Patent: Apr. 13, 2010

(54) INKJET PRINTER AND A HOSE FOR USE IN THE INKJET PRINTER

(75) Inventor: Antonius P. M. M. Van Roy, Grashoek (NL)

(73) Assignee: Océ-Technologies B.V., Venlo (NL)

( * ) Notice: Subject to any disclaimer, the term of this patent is extended or adjusted under 35 U.S.C. 154(b) by 793 days.

(21) Appl. No.: 11/489,409

(22) Filed: Jul. 20, 2006

(65) Prior Publication Data

US 2007/0030320 A1 Feb. 8, 2007

(30) Foreign Application Priority Data

Aug. 3, 2005 (EP) ..... 05107156

(51) Int. Cl.
*B41J 2/175* (2006.01)

(52) U.S. Cl. ..... 347/85

(58) Field of Classification Search ..... 138/137; 347/85

See application file for complete search history.

(56) References Cited

U.S. PATENT DOCUMENTS 5,650,811 A * 7/1997 Seccombe et al. ..... 347/85
5,988,801 A 11/1999 Coiner
6,557,987 B1 5/2003 Shibata et al.
7,281,547 B2 * 10/2007 Cleveland et al. ..... 138/137

FOREIGN PATENT DOCUMENTS

| | | | |
|---|---|---|---|
| CN | 674 763 A5 | | 7/1990 |
| EP | 0 684 138 | | 11/1995 |
| JP | 56-6979 | * | 1/1981 |
| JP | 62-288045 A | | 12/1987 |
| JP | 2-111555 A | | 4/1990 |
| JP | 2004-142406 A | | 5/2004 |

* cited by examiner

*Primary Examiner*—Julian D Huffman
(74) *Attorney, Agent, or Firm*—Birch, Stewart Kolasch, & Birch LLP

(57) ABSTRACT

An inkjet printer having a print head mounted on a carriage and an off-carriage ink reservoir, the carriage being arranged for moving the print head relative to a receiving medium, wherein the printer includes a hose for connecting the print head to the reservoir to enable the supply of ink from the reservoir to the print head, the hose having a multi-layered wall, containing an intermediate poly-urethane compound containing layer disposed between low density poly-ethylene compound-containing layers.

9 Claims, 2 Drawing Sheets

INKJET PRINTER AND A HOSE FOR USE IN THE INKJET PRINTER

This application claims the priority benefit of European Patent Application No. 05107156.1 filed on Aug. 3, 2005, which is hereby incorporated by reference.

BACKGROUND OF THE INVENTION

The present invention pertains to an inkjet printer comprising a print head mounted on a carriage and an off-carriage ink reservoir, the carriage being arranged for moving the print head relative to a receiving medium. The printer comprises a hose for connecting the print head to the reservoir to enable the supply of ink from the reservoir to the print head, the hose having a multi-layered wall. The present invention also relates to the use of the hose in the inkjet printer.

The printer is known from U.S. Pat. No. 5,988,801. The known printer includes a medium transporting system for transporting the receiving medium along a medium path to a print area and a scanning carriage for holding the print head. The carriage can be scanned along a scanning axis transverse to the media path at the print area. The printer includes a fixed ink supply station including an ink reservoir. In order to connect the movable print head to the reservoir, the printer is provided with a fluid conduit for the flow of ink, the conduit comprising a flexible hose having a multi-layered wall and routed such that a flexible loop is formed therein. The multi-layered wall provides for a sufficient barrier to water vapor transmission and oxygen permeability. This kind of separate fixed ink supply arrangement is typical for large format printers, e.g., for plotting engineering drawings and printing color posters. For these applications there is a requirement for the use of much larger volumes of ink than the volumes that can be contained within the print heads themselves. Therefore, separate ink reservoir systems have been developed which provide an external stationary ink supply that is connected to the scanning print head via a hose. The external ink reservoir is known for example as "off-axis", "off-board", or "off-carriage". In the known printer, typical problems with these off-axis ink reservoirs, such as mechanical damage of the hose due to an induced kink, vapor losses from the hose, air diffusion into the hose etc. have been resolved adequately by providing a flexible multi-layered wall, each layer having it's own dedicated task to avoid the known problems. This has been outlined in great detail in the above identified U.S. patent, starting in column 3, line 64 end ending in column 7, line 53. However, the known inkjet printer has an important disadvantage. The durability of the hose is relatively poor. After a few months of operation of a typical large format printer, the air and vapor tightness of the hose can decrease to an inadequate level. It is also known that the layers can separate which may cause mechanical damage to the hose, resulting in inadequate water vapor and air tightness. Accordingly, the problems known before, such as the change of ink properties, degrading print quality, print head starvation etc. may again arise. Replacement of the bad hose often requires replacement of the complete tubing system, which is relatively expensive.

SUMMARY OF THE INVENTION

Accordingly, It is an object of the present invention to overcome or at least mitigate this problem. To this end, the printer is provided with a hose having a wall which comprises an intermediate poly-urethane compound-containing layer provided between low density poly-ethylene compound containing layers. Surprisingly it has been found that a very durable hose can be attained, which can be advantageously used to connect the print head to the ink reservoir. Such a hose meets all the necessary requirements for an ink hose, such as water and air tightness, flexibility, and sufficient smoothness, and is easy to make due to the good processing properties of the various compounds utilized. In addition, the hose can maintain it's good properties even when the hose is used for up to a year or longer. It appears that there is no need for any extra layers besides the intermediate polyurethane compound containing layer and the LDPE compound-containing layers. Thus, in principal, a three layer wall can fulfill all the necessary requirements. However, additional layers may be provided, for example between the polyurethane compound-containing layer and one of the LDPE compound containing layers, or as an extra layer provided on the inside and/or outside of the hose, in order to meet extra or more stringent requirements. It is noted that the layers may be constituted solely out of a polyurethane material or a low density polyethylene material, respectively, or may contain other components for achieving specific desired results.

In one embodiment, the polyurethane layer comprises a thermoplastic polyurethane compound. It appears that this improves the processing properties of the urethane compound markedly, because curing processes for the polyurethane layer can be avoided in this way.

In another embodiment, the polyurethane compound-containing layer is transparent for light with a wavelength of between 400 and 750 nm. In this embodiment, the hose can be made transparent, so that the colored ink in the hose can be seen with the naked human eye. This provides the advantage that the presence, or even more importantly, the non-presence of ink can be seen when just looking at the hose. This is an important advantage in the process of trouble-shooting when the print head is malfunctioning.

In another embodiment the polyurethane compound has an elongation at break of more than 500%, as measured by the test method according to DIN 53504-S2. It appears that such a compound enables the hose to be more flexible and decreases the risk of kinks in the hose. This advantage is even more pronounced when it is combined with a polyethylene compound having an elongation at break of more than 1000%. In a further embodiment, the polyethylene compounds have a melt index of more than 5 g/10 min, as measured by the test method according to ASTM D 1238 (190° C./2.16 kg). This appears to further increase the advantages of the present hose.

The present invention also pertains to a multi-layered hose for use in an inkjet printer to connect an ink reservoir to a print head which is movably arranged with respect to the ink reservoir, the hose comprising an intermediate poly-urethane compound-containing layer disposed between low density poly-ethylene compound-containing layers.

BRIEF DESCRIPTION OF DRAWINGS

The present invention will now be explained in more detail with reference to the following figures, wherein, FIG. 1 schematically shows a cross-sectional view of a hose for transporting fluid Ink.

DETAILED DESCRIPTION OF INVENTION

Figure 1:
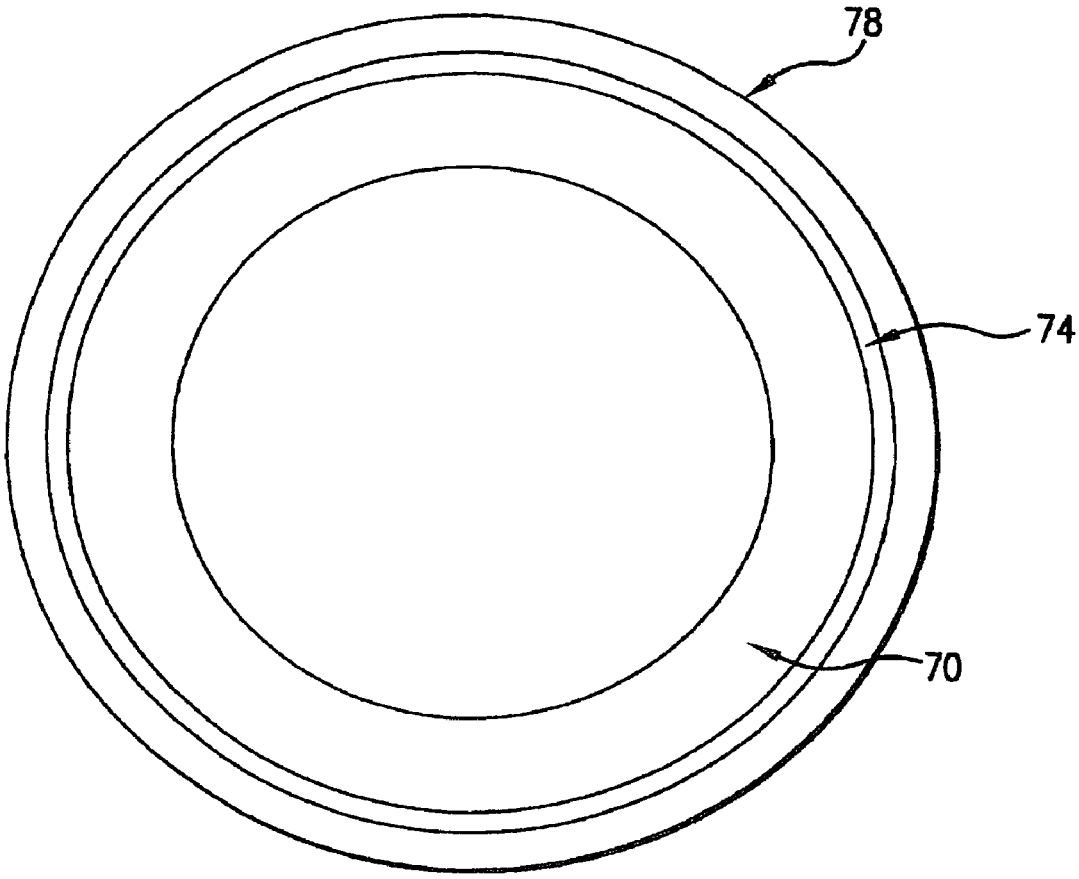

FIG. 1 schematically shows a cross-sectional view of a hose for transporting fluid ink. This hose as an internal diameter of 2.25 mm and an external diameter of 4.15 mm. Layer 70 consist essentially of LDPE (Low density polyethylene), in particular the material "Exact Plastomer 8210" available from DEX-Plastomers, a DSM/ExxonMobil Chemical joint venture registered in the Netherlands. This layer has a thickness of 0.9 mm. Layer 74 consists essentially of a 0.2 mm thick polyurethane compound, in particular the compound "Elastollan 1180 A", a thermoplastic polyether-polyurethane, available from Elastogran GmbH (belonging to the BASF group), Lemförde, Germany. Layer 78 has a thickness of 0.8 mm and consist essentially of LDPE, in particular the material "Exact Plastomer 8210". Such a hose can be made by well known co-extrusion processes such as for example as known from Hensen, Knappe, Potente: Kunststof-Extrusionstechnik I, München: Carl Hanser Verlag, 1989.

Figure 2:
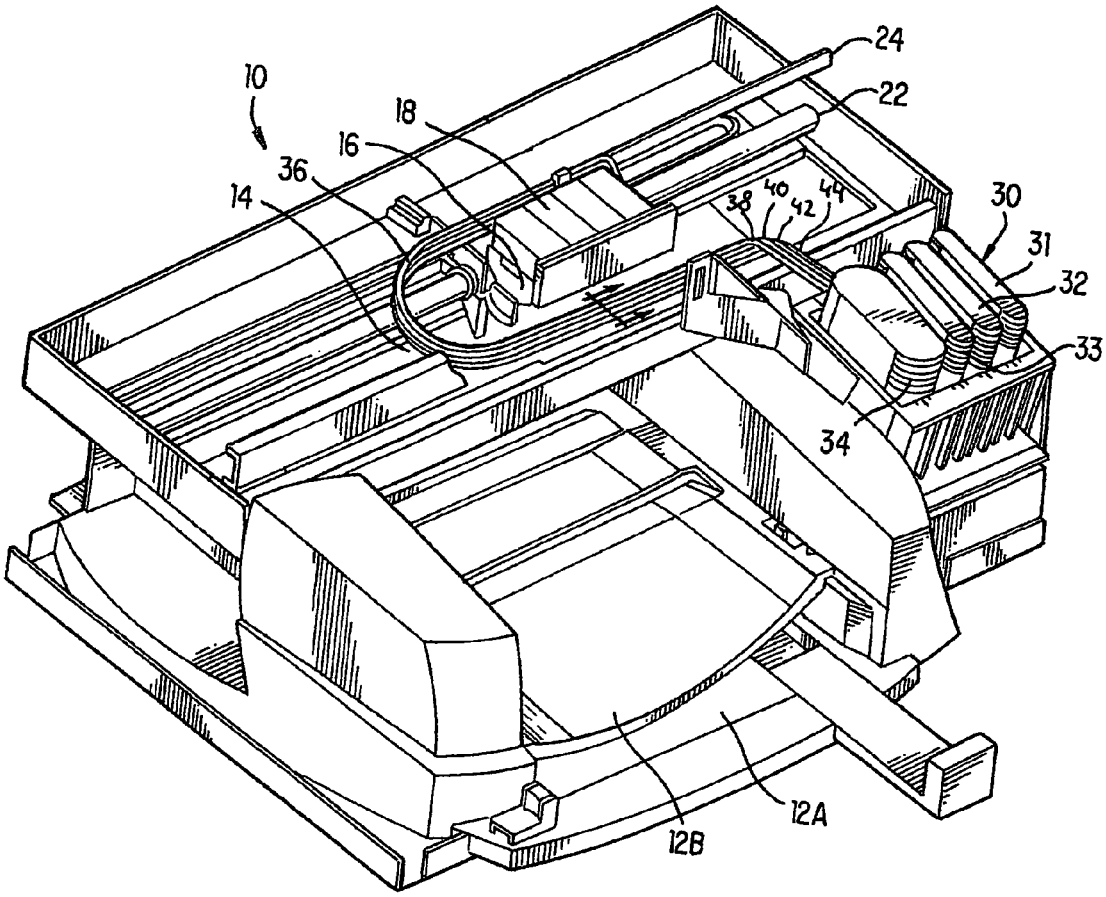
FIG. 2 is a perspective view of an inkjet printer which incorporates the present invention.

FIG. 2 is a perspective view of an inkjet printer suitable for utilizing the present invention. As such, the printer is known from U.S. Pat. No. 5,988,801 and described therein in full detail. Generally, the printer 10 includes a tray 12A for holding an input supply of paper or other print media. When a printing operation is initiated, a sheet of paper is fed into the printer using a sheet feeder, and then brought around in a U direction to travel in the opposite direction toward output tray 12B. The sheet is stopped in a print zone 14, and a scanning carriage 16, containing one or more print heads 18, is then scanned across the sheet for printing a swath of ink thereon. After a single scan or multiple scans, the sheet is then incrementally shifted using a stepper motor and feed rollers (not shown in FIG. 2) to a next position within the print zone 14, and carriage 16 again scans across the sheet for printing a next swath of ink. When printing on the sheet is complete, the sheet is forwarded to a position above the tray 12B, held in that position to ensure the ink is dry, and then released. Alternate embodiments of the printer include those with an output tray located at the back of the printer 10, where the sheet of paper is fed through print zone 14 without being fed back in a U direction.

The carriage 16 scanning mechanism may be conventional, and generally includes a slide rod 22, along which carriage 16 slides, and a coded strip 24 which is optically detected by a photo detector in carriage 16 for precisely positioning carriage 16. A stepper motor (not shown), connected to carriage 16 using a conventional drive belt and pulley arrangement, is used for transporting carriage 16 across print zone 14. Other features of the inkjet printer 10 relate to the ink delivery system for delivering ink to the print heads 18 from an off-carriage ink supply station 30 containing replaceable ink reservoirs 31, 32, 33 and 34. For color printers, there will typically be a separate station for black ink, yellow ink, magenta ink, and cyan ink. Since black ink tends to be depleted most rapidly, the black ink reservoir 34 has a larger capacity than the capacities of the other ink reservoirs 31-33.

Novel features of the present invention pertain to the tubing set 36 that comprises four hoses 38, 40, 42 and 44 that transport ink from the four off-carriage ink reservoirs to the four print heads 18. In accordance with the present invention the hoses have three-layer walls as described with reference to FIG. 1. These hoses provide for the necessary flexibility and air and vapor tightness, and have a prolonged durability when compared with the hoses known in the prior art. It is noted that installation of the printer, which includes connecting the reservoirs to the print heads by fitting the tube system, occasionally goes together with causing a kink in one or more of the hoses. In order to avoid the need for a replacement of the complete tubing system ab initio, the corresponding hose can be re-enforced at the location of the kink by fitting a spiral spring or the like around the hose. This prevents the hose from buckling easily at the location of the original kink.

The invention being thus described, it will be obvious that the same may e varied in many ways. Such variations are not to be regarded as a departure from the spirit and scope of the invention, and all such modifications as would be obvious to one skilled in the art are intended to be included within the scope of the following claims.

The invention claimed is:

1. Inkjet printer comprising a print head mounted on a carriage and an off-carriage ink reservoir, the carriage being arranged for moving the print head relative to a receiving medium, the printer containing a hose connecting the print head to the reservoir to enable supply of ink from the reservoir to the print head, the hose having a multi-layered wall, which comprises an intermediate polyurethane compound containing layer disposed between low density polyethylene compound-containing layers, wherein the polyethylene compounds in said polyethylene compound-containing layers have a melt index of more than 5 g/10 min. and an elongation, at break of more than 1000%.

2. The inkjet printer according to claim 1, wherein the polyurethane layer comprises a thermoplastic polyurethane compound.

3. The inkjet printer according to claim 1, wherein the polyurethane compound-containing layer is transparent for light with a wavelength between 400 and 750 nm, whereby the presence or absence of ink can be visually observed.

4. The inkjet printer according to claim 1, wherein the polyurethane compound has an elongation at break of more than 500%.

5. A multi-layered hose for use in an inkjet printer to connect an ink reservoir to a print head that is movably arranged with respect to the ink reservoir, which comprises an intermediate polyurethane compound-containing layer disposed between low density polyethylene compound-containing layers, wherein the polyurethane compound-containing layer has a thickness of 0.2 mm.

6. Inkjet printer comprising a print head mounted on a carriage and an off-carriage ink reservoir, the carriage being arranged for moving the print head relative to a receiving medium, the printer containing a hose connecting the print head to the reservoir to enable supply of ink from the reservoir to the print head, the hose having a multi-layered wall, which consists essentially of an intermediate polyurethane compound containing layer disposed between low density polyethylene compound-containing layers.

7. Inkjet printer comprising a print head mounted on a carriage and an off-carriage ink reservoir, the carriage being arranged for moving the print head relative to a receiving medium, the printer containing a hose connecting the print head to the reservoir to enable supply of ink from the reservoir to the print head, the hose having a multi-layered wall, which comprises an intermediate polyurethane compound containing layer disposed between low density polyethylene compound-containing layers, wherein the polyurethane compound-containing layer has a thickness of 0.2 mm.

8. Inkjet printer comprising a print head mounted on a carriage and an off-carriage ink reservoir, the carriage being arranged for moving the print head relative to a receiving medium, the printer containing a hose connecting the print head to the reservoir to enable supply of ink from the reservoir to the print head, the hose having a multi-layered wall, which comprises an intermediate polyurethane compound containing layer disposed between low density polyethylene compound-containing layers, wherein the multi-layered wall comprises the polyurethane compound having a thickness of 0.2 mm, an inner layer of low density polyethylene having a thickness of 0.9 mm and an outer layer of low density polyethylene having a thickness of 0.8 mm.

9. A multi-layered hose for use in an inkjet printer to connect an ink reservoir to a print head that is movably arranged with respect to the ink reservoir, which comprises an intermediate polyurethane compound-containing layer disposed between low density polyethylene compound-containing layers, wherein the multi-layered wall comprises the polyurethane compound having a thickness of 0.2 mm, an inner layer of low density polyethylene having a thickness of 0.9 mm and an outer layer of low density polyethylene having a thickness of 0.8 mm.

* * * * *